US006318833B1

(12) United States Patent
Lyman et al.

(10) Patent No.: US 6,318,833 B1
(45) Date of Patent: Nov. 20, 2001

(54) STATE AND SEQUENCE CONTROL IN INK JET PRINTING SYSTEMS

(75) Inventors: Dan C. Lyman, Cincinnati; John N. Blum, Kettering, both of OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/455,067

(22) Filed: Dec. 6, 1999

(51) Int. Cl.[7] ..... B41J 29/393
(52) U.S. Cl. ..... 347/19
(58) Field of Search ..... 347/5, 19, 73, 347/74, 78

(56) References Cited

U.S. PATENT DOCUMENTS 4,813,912 * 3/1989 Chickneas et al. ..... 347/2
4,970,527 * 11/1990 Gatten ..... 347/23
5,889,537 * 3/1999 Shimada ..... 347/41
5,930,551 * 7/1999 Nakazato et al. ..... 399/1
6,132,021 * 10/2000 Smith et al. ..... 347/19
6,155,664 * 12/2000 Cook ..... 347/19

* cited by examiner

*Primary Examiner*—John Barlow
*Assistant Examiner*—Robert D Loper, Jr.
(74) *Attorney, Agent, or Firm*—Barbara Joan Haushalter

(57) ABSTRACT

A method and self-configuring structure are provided for optimizing state and state sequencing in ink jet printing system operation. A plurality of operating states are defined and assembled into at least one operating sequence. A conditional test is applied to the defined operating state. Execution flow can then be changed based on results of the conditional test. Finally, the defined operating states and assembled sequences are organized into an interpretable document.

15 Claims, 5 Drawing Sheets

| Sequence 2 | Step Ready | | | | | | | | | |
|---|---|---|---|---|---|---|---|---|---|---|
| | State Number | 1 | 2 | 3 | 4 | 5 | 6 | 7 | 8 | Explanation |
| | Ink Pump Control | 29000 | 0.8 | 24000 | 0.8 | -1 | -1 | -1 | -1 | See Table 2 |
| | Vavuum Level | 12 | 12 | 12 | 12 | 12 | 12 | 12 | 12 | Servo to this value in in. Hg. |
| | Stimulation Level | 0 | 0 | 0 | 0 | 0 | -1 | -1 | -1 | See Table 3 |
| | Charge Voltage | 0 | 0 | 0 | 0 | 0 | 0 | 0 | 0 | See Table 4 |
| | Charge Plate Short Detect enabled | 0 | 0 | 0 | 0 | 0 | 0 | 0 | 14 | 0 disabled/14 enabled |
| | Eyelid Position | 0 | 0 | 2 | 2 | 2 | 2 | 2 | 2 | 0 Closed/2 Open Position 2 |
| | Cross Flush Valve | 1 | 1 | 1 | 1 | 0 | 0 | 0 | 0 | 0 closed/1 open |
| | Catcher Valve | 1 | 1 | 1 | 1 | 0 | 0 | 0 | 0 | 0 closed/1 open |
| | Display Message | 0 | 257 | 0 | 8192 | 4 | 512 | 0 | 0 | See Table 5 |
| | Ink Healer | 0 | 5 | 5 | 2 | 5 | 5 | 0 | 4 | See Table 6 |
| | charge plate healer | 0 | 0 | 0 | 0 | 0 | 0 | 0 | 0 | Fraction of Full heater Power |
| | Ink Fill Enabled | 0 | 0 | 3 | 3 | 3 | 3 | 3 | 3 | See Table 7 |
| | Ready to Print | 0 | 0 | 0 | 0 | 0 | 0 | 0 | 0 | 0 not Ready/1 Ready |
| | State Time | 1 | 7 | 2 | 5 | 5 | 2 | 5 | 75 | Seconds |
| | | | | | | | | | | |
| | Jump Immediate Test Number | 8 | 10 | 0 | 5 | 6 | 6 | 6 | 6 | See Table 8 |
| | Jump Immediate Destination | ALLOFF | RDYCLEAN1 | NEXT | NEXT | PREVIOUS | PREVIOUS | PREVIOUS | BACK2 | See Table 9 |
| | | | | | | | | | | |
| | Jump delayed Test Number | 1 | 34 | 0 | 38 | 5 | 5 | 33 | 0 | See Table 8 |
| | Jump delayed Destination | NEXT | NEXT | NEXT | NEXT | NEXT | NEXT | NEXT | NEXT | See Table 9 |
| | State Label | StepRead | | | | | | | | |
| | | Check for last Printhead installed | Clean if the last sequence completed was a shutdown, check for eyelid open, hold if eyelid is | No conditional test | Hold till ink temperature is greater than the STARTTEMP value in ink#.dex file or operator ste | Hold without stimulation, operator steps backward to previous state, forward to next state | Hold with stimulation on, operator steps back to previous state forward to next state | Hold here if other Printhead is in the condensate state, jump back 1 state if operator steps backward | Start condensate clean, jump back 2 states if operator steps backward. | |

FIG. 3

| CONDITION NUMBER | MEANING |
|---|---|
| 0 | Never Jump |
| 1 | Always Jump |
| 2 | Ink Tank Full |
| 3 | Pressure +/− .5 PSI of target |
| 4 | Operator input to step forward |
| 5 | Operator input to step backward |
| 6 | Printhead removed or not ready |
| 7 | System ink number = PH ink Number |
| 8 | Ink temperature >= start temperature |
| 9 | Fluid level in ink tank is above top fluid switch |
| 10 | On both sides, eyelid is closed or side is in All Off |
| 11 | Catchplan installed |
| 12 | OCS Calibration Complete |
| 13 | Condition 10 is true AND condition 4 is true. |

FIG. 4

| Field | Values/Meaning | |
|---|---|---|
| ink pump control | 0.0 – 100.0 | servo printhead pressure to this value (in psi) |
| | 100 – 65535 | run pump open loop at this drive level (65535 is fully energized) |
| | –1 | servo to the value stored in the printhead |
| stim control | –1 | servo to the tab feedback rms level corresponding to the value stored in the printhead |
| | "SUPER" | super stim the resonator using parameters stored in the printhead (also can be expressed as –2). |
| | all other | servo to this value in mVrms |
| charge voltage control | –1 | set charge voltage to the value stored in the printhead |
| | 0 – 205.0 | set charge voltage to this value |
| | <0 AND –1 | set charge voltage to the value stored in the printhead plus this value (e.g. if the field value is –5 and the printhead voltage is 135.3, the target voltage will be 130.3). |
| umbilical heater control | 0 | disabled (off) |
| | 1 | on |
| | 2 | servo ink temperature to control temperature |
| | 3 | servo ink temperature to ambient temperature + delta temperature |
| | 4 | servo ink temperature to condensation temperature |
| | 5 | servo ink temperature to start temperature |
| | Note: control, delta, condensation, and start temperatures are loaded from the inkdex file. | |
| fluid fill control | 0 | disabled for this side |

FIG. 5A

| | | |
|---|---|---|
| fluid fill control | 0 | disabled for this side |
| | 1 | enabled for this side |
| | 2 | enable ink fill |
| | 3 | inhibit all fill |
| | 4 | fill with ink, regardless of level |
| | 5 | fill with both, regardless of level |
| | 6 | fill with ink only but do not perform calibration after fill is complete |
| destination of immediate jump | "NEXT" | jump to next state (also can be expressed as 1000) |
| | "PREVIOUS" | jump to start of the previous state (also can be expressed as 1000) |
| | "BACK2" | jump to start of the state before the previous state (also can be expressed as 1002) |
| | keyword | jump to the start of the sequence corresponding to the keyword (Note: Keywords are not followed by the left bracket "(" when used here.) |
| destination of delayed jump | "NEXT" | jump to next state (also can be expressed as 1000) |
| | "PREVIOUS" | jump to start of the previous state (also can be expressed as 1000) |
| | "BACK2" | jump to start of the state before the previous state (also can be expressed as 1002) |
| | keyword | jump to the start of the sequence corresponding to the keyword (Note: Keywords are not followed by the left bracket "(" when used here.) |
| start time | −1 | sequence is complete–remain in this state indefinitely |
| | 0 – 65535 | seconds in the state |

FIG. 5B

STATE AND SEQUENCE CONTROL IN INK JET PRINTING SYSTEMS

TECHNICAL FIELD

The present invention relates to the field of continuous ink jet printing and, more particularly, to a method for improving state and sequence control of a continuous ink jet printing system.

BACKGROUND ART

Proper operation of an ink jet printer requires parameters such as pressure, charging voltage, deflection voltage, stimulation amplitude and charge phase to be properly set. The appropriate value for each of these operational parameters will depend on several items. Because of differences in ink properties such as viscosity and surface tension, the optimal point for these operational parameters will vary from ink type to ink type. As the fluid properties of the ink are temperature dependent, the optimal setting for these operational parameters are also temperature dependent. Different ink will have different temperature dependencies as a result of its composition.

During operation of the printer, the concentration of the ink can changes. As the concentration of the ink drifts, the optimal point of the operational parameters will also shift. If left uncorrected, the changing concentration of the ink can make the ink jet printer not operable. Rather than allow this to occur, ink jet printers typically include some means to monitor the ink concentration. If the concentration of the ink rises due to evaporation, the printer controls system will take corrective action by adding a replenishment fluid to drive the ink concentration back to the concentration set point. Means used to monitor the concentration include measurements of viscosity, resistivity or optical absorbance. Different inks will have different values for measured parameters at the desired concentration set point.

The operational parameters for the printer will depend on the characteristics of the printhead. For example, printheads with larger than nominal orifices might require slightly different pressures, charge voltage, and stimulation amplitude than printheads with smaller orifices.

Typical prior art systems could not self-configure themselves to properly set each of the operational parameters. Instead, the operator had to set various of these parameters. For example, the operator might have been given a printed list of parameters to set when changing a printhead. In other cases, these parameters would have to be determined experimentally, either manually by the operator or by a diagnostic test carried out by the printer, after installing a printhead. Changes in ink type either required the inks to operate at the same conditions or the new conditions had to be determined experimentally. No means was provided to deal with different temperature dependence characteristic for different ink. Differences in the measurement parameter for the concentration control from one ink type to another was also not dealt with.

In addition to the issue of operational parameters, different ink or printheads might require changes in the startup or shutdown sequences for optimal reliability. In continuous ink jet printing systems, it is necessary to execute a sequence of states in order to effectively perform operations of the systems. A particular sequence is used, for example, to bring the printhead to a ready-to-print condition. Another is used to shut down the printhead. And another is used to clean the printhead.

A state describes the physical configuration of the system, including valve positions, vacuum and ink pump operation, heater operation, and whether certain evolutions are enabled (ink fill, for example). The sequences and states are stored in processor memory in files known as state tables. Different state tables may be used for different inks.

U.S. patent application Ser. No. 08/810,653 now abandoned has provided a means for dealing with the issues of operational parameters, different ink or printheads which can require changes in the startup or shutdown sequences for optimal reliability. That application describes a system which is supplied with an index of available inks. For each ink type, setup values for each operation parameter are given. The temperature dependence of various of these parameters are also given. Furthermore, set points for the measured parameter of the concentration control are given. The control computer inputs a file with printer related characteristics. These might include values related to the measurement system used for concentration control. For example, in a resistivity measurement cell for concentration, small changes in the spacings of the electrodes might produce a shift in the measured voltage or current from the cell at the desired set point. Such a correction or parameter might be included in the printer configuration files. Other values in the printer configuration files might include revision level of hardware or software information which might affect setup.

Additional input files for the computer can include printhead related values. These values can provide a means to correct or account for manufacturing tolerance related shifts in the operating parameters. Such values might be supplied directly from a memory unit built into the printhead, or by means of an externally supplied file, on a floppy disk for example.

Application Ser. No. 08/810,653 now abandoned provides an efficient manner to store and utilize this information in the form of tables or matrix arrays. For example, each step in a start up sequence can be stored as a matrix of values, where each location in the matrix corresponds to status of a particular valve, pump or other component. The whole start up sequence then corresponds to an array identifying the order of such steps. Values of the various operating parameters as determined by the various input files are either inserted directly or combined appropriately and then inserted into the appropriate control matrix locations. For example if ink XXX is installed, the data from the ink characteristic matrix appropriate for ink XXX is accessed and inserted into the appropriate printer control matrix. From the same ink characteristic matrix, temperature compensation parameters are retrieved to modify the control equations. A different sequence of startup steps might also be called out by the data from the ink characteristic matrix.

In application Ser. No. 08/810,653, now abandoned states were executed sequentially within a sequence. Most states were executed for a finite length of time. A few states, such as end of sequence states, had no defined operating time. The printer would remain in the state until the operator called for a change of sequence or to progress to the next state in the sequence.

While this provided an efficient means to configure the printer to properly set the various operating parameters and control sequences in response to differing printhead, ink and fluid system component characteristics, it also had significant limitations. For example, if one desired for the system to pause in a particular state until the system warmed up to a threshold temperature, there was no method to do so except to guess the length of time that it might take to reach that temperature. Thus, sometimes the system might remain in the state longer than necessary. This could result in unnecessary delay in restarting the printer. Other times, the system might exit the state without reaching the temperature threshold. This might produce an ink jet related error which would require the printhead to be restarted from the first state in the startup sequence. The effect would be a lower apparent reliability for the printer and a prolonged startup sequence.

Therefore, it would be desirable to have an improved method for control of sequencing of states in an ink jet printing system, which maintains self configuring characteristics while providing more flexibility to control of state sequencing.

SUMMARY OF THE INVENTION

This need is met by the technique of the present invention. The present invention adds significant functionality to application Ser. No. 08/810,653, now abandoned by allowing the individual states to incorporate conditional tests. One such conditional test, for example, would not allow the printer to advance to the next step in the sequence until the desired ink temperature was reached. If an unacceptably long time were to pass without reaching temperature, an error message could be given suggesting a heater failure.

In accordance with one aspect of the present invention, a self-configuring ink jet printing structure is provided. To a control structure which can optimize operating sequences of the printer based on printhead related parameters, ink related parameters, and an easily edited sequence table structure, the present invention adds the ability to use conditional tests. These conditional tests are implemented into the self-configuring structure to optimize state and state sequencing in the printing system operating.

Other objects and advantages of the invention will be apparent from the following description, the accompanying drawing and the appended claims.

BRIEF DESCRIPTION OF THE DRAWING

FIG. 3 is a table or matrix of fields defining states and use of conditional tests to determine the sequencing of the states;

FIG. 4 is a table listing conditional tests; and

FIGS. 5A and 5B show a table describing control parameters found in the table of FIG. 3, and jumping options based on the conditional test results from the table of FIG. 4.

DETAILED DESCRIPTION OF THE INVENTION

Printing systems using ink jet technology produce images on a print media, usually paper. The system employs any of a variety of sized printheads.

The printing system can print anywhere on a document, using a variety of type styles, point sizes, ink colors, and special effects.

Images are formed on the web by individual drops of ink released by a printhead at a density of, for example, 300 drops per inch for a nine inch printer, in the direction across the array. The printing system uses continuous jet technology, in which the printhead releases a continuous stream of ink drops. Drops that are needed to form an image fall onto the web, while drops that are not needed receive an electric charge and are deflected into a catcher, for recirculation.

Imaging can be accomplished using multiple and independent printheads, and each head may image different colors. The printheads are of the binary, continuous ink jet type, and employ planar charging technology known in the art.

Figure 1:
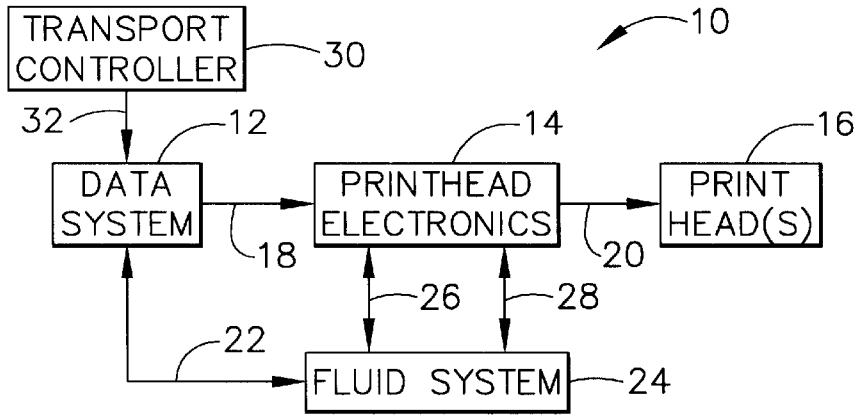
FIG. 1 is a block diagram of the main components of an ink jet printing system capable of employing the state and sequence control of the present invention.

Referring to the drawings, FIG. 1 is a block diagram of the main components of an ink jet printing system 10. A data system 12 receives and provides information to the various components of the ink jet printing system. A printhead electronics block 14 controls printhead(s) 16. Print data and control bits from the data system 12 are sent to the printhead electronics 14 over a data and control interface 18. Control and status of the printhead electronics 14 are sent over the printhead control and status interface 20. A fluid system control and status interface 22 connects a fluid system 24 and the data system 12. A printhead control and status interface 26 and a synchronizing and control interface 28 provide data between the printhead electronics 14 and the fluid system 24. Finally, a transport controller 30 sends data via a transport controller interface 32 to the data system 12.

Figure 2:
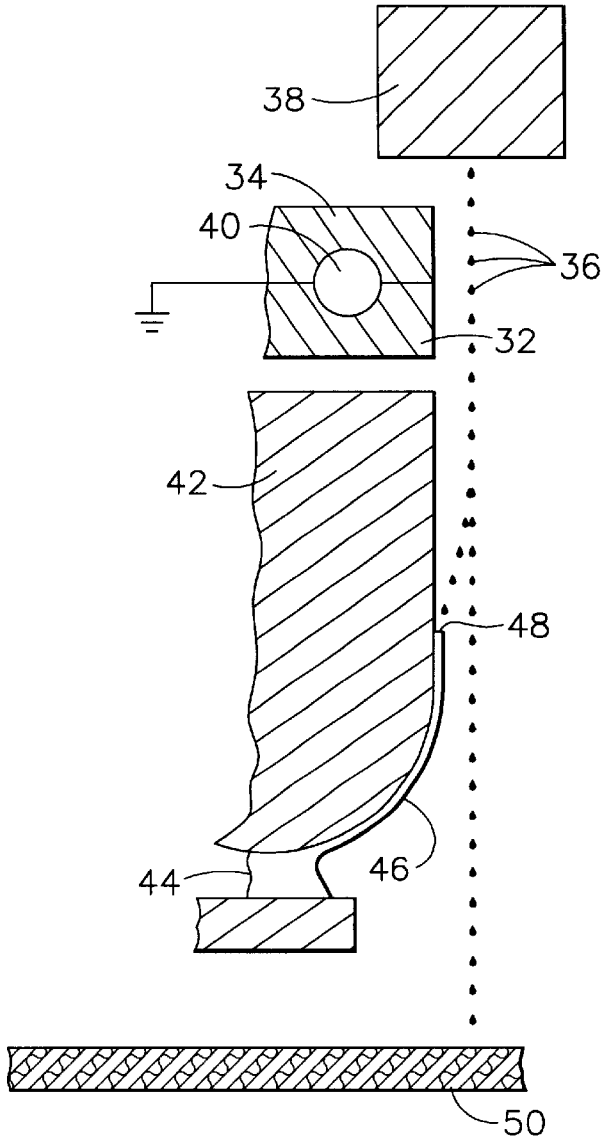
FIG. 2 is a side view of a continuous ink jet system of the type suitable for use with the state and sequence control concept of the present invention.

The present invention relates to the type of continuous ink jet system illustrated in FIG. 2. A plurality of jets is created at high spatial resolution by a drop generator, which stimulates the natural break-up of jets into uniform streams of droplets. A plurality of conducting elements, or charge leads 32, are located on a planar charge plate 34. A plurality of streams of drops 36 are supplied by drop generator 38. A plurality of independently switchable sources 40 of electrostatic potential are supplied to the plurality of charge leads 32. A catcher 42 intercepts the slightly deflected streams of drops. The plurality of streams of drops impacting on the catcher forms a film of ink 46, which in turn forms a flow of ink 44, sucked away from the face of the catcher by a vacuum. Reference number 48 represents the area on the catcher at which the deflected drops impact the catcher and merge together to form a film of ink on the catcher face. The undeflected ink drops then print the image on substrate 50.

As ink jet printer systems grow increasingly more complex and the types, colors and variety of inks used in such systems increase, the optimum state and optimum sequence of states of the ink jet printer for particular applications grows more varied. The present invention addresses these variations by improving the control of sequencing of states in a continuous ink jet system. The present invention provides the capability for branching based on various system conditions.

As discussed in commonly assigned co-pending patent application Ser. No. 08/810,653, now abandoned totally incorporated herein by reference, operation of an ink jet printer is controlled by a set of operating tables and files. Data from these various files and tables are used to configure the printer for optimum operation of any printhead with any of the available inks. During initiation of the printer, the system reads the data file for the ink being used.

This file contains data related to the color of the ink, the control points for the concentration control system, and information related to preferred stimulation amplitudes and charge voltage. Various other parameters for proper operation of the printer with this ink are also provided. This ink data file also specifies a set a state tables for use with this ink. The specified set of state tables includes a number of sequences for starting and stopping the printer, and for cleaning the printhead.

The Table of FIG. 3 shows a portion of a start up sequence. It contains neither the total number of states normally used in such a sequence nor the number of control parameters typically included, and is being shown merely for purposes of example. In this sequence, identified as Sequence 2 or "Step Ready", are eight states numbered 1 through 8 across the top of the Table. The states have corresponding columns. The state variables or parameters are shown as rows. Ink pump control, for example, is the first state parameter listed. As shown, the ink pump can be set to fixed pump speed or fixed pressure for different states in the sequence. The pressure can also be servoed to a pressure specified by a value stored in the printhead memory. Similarly, charge voltage, stimulation amplitude and other parameters can be defined for any state either as fixed values or values defined by printhead stored parameters and by ink properties related parameters. The present invention adds to the structure of the prior art by adding the ability to incorporate conditional tests into the various sequences for printhead operation.

Upon entering a state having a conditional test, the jump immediate test is carried out immediately. The Table of FIG. 4 illustrates some of the conditional tests which can be utilized. If the statement is true, the system jumps immediately to the designated state or sequence. If the statement is false, the system continues checking the validity of the jump immediate statement. Checking of the jump immediate test is continued until the statement becomes true or until the time the state reaches the defined state time limit. If the state time limit is reached without the jump immediate test being passed, the system will continue to perform the jump immediate test.

In addition, the jump delayed test is carried out. This logical statement of this test may be the same as the jump immediate test or it may be some other logical statement. If the jump delayed test is passed, the operating sequence will jump to the designated state or sequence for the jump delay test. If the jump delayed test is false, the sequence will halt until the condition is met, or until the operator directs the system to another sequence via the control panel.

The conditional statements can make tests on a variety of variables or parameters. These include measurement made by the system, such as temperature, or times in various states or conditions of the system. These also include data from the ink parameter tables, such as the ink dependent temperature limit. The conditional tests can also involve printhead operating parameters which are stored in the printhead. One such parameter is the ink number of the last ink used in the printhead. The conditionals may also use operator input, such as the pushing of a button or the removal of a print head, that is sensed by the system. It is even possible to combine conditional tests to form a single condition test. The Table of FIG. 4 illustrates tests for instructional purposes only and is not to be considered as limiting the invention.

If the conditional test is true, a step is made to the state specified as the destination state. The Table of FIGS. 5A and 5B indicates the jumping options. As indicated previously, the system can step forward and backward in the sequence, or it can jump to states in other sequences. For example, consider the conditional tests found in state 1 of FIG. 3. If the printhead has been removed or is not ready, the jump immediate test is true. The system immediately jumps to the state with the label ALLOFF, which shuts down the system. In this way, the system can avoid turning on the fluid system when no printhead is present. If a printhead is installed, the test is false. After a state time of one second, the jump delayed test is carried out. The test in this case always makes the jump to the designated state. The designated state for this conditional test is the next (NEXT) state in the sequence.

While the sequence table of FIG. 3 is in a clear format of rows and columns, the equivalent data could be stored in the computer system in multiple manners. For example, the equivalent data could be stored in the computer system in the form of data strings in delimited or fixed length format. It could also be in encrypted or encoded form to prevent the customer from modifying these tables.

The invention has been described in detail with particular reference to certain preferred embodiments thereof, but it will be understood that modifications and variations can be effected within the spirit and scope of the invention.

What is claimed is:

1. A self-configuring structure comprising:

a plurality of defined operating states;

means for assembling a collection of defined operating states into at least one operating sequence; and means for comparing ink jet characteristics to the at least one operating sequence for every function of every ink formulation.

2. A self-configuring structure as claimed in claim 1 further comprising means for applying a conditional test to each state.

3. A self-configuring structure as claimed in claim 2 further comprising means for changing execution flow based on results of the conditional test.

4. A self-configuring structure as claimed in claim 3 further comprising means for organizing the defined operating states and assembled sequences into an interpretable document.

5. A method for optimizing ink jet printing system operation using a computer for interactive control of an ink jet printing system, comprising the steps of:

storing ink jet characteristics in a computer memory;

accessing the stored ink jet characteristics with the computer;

matrixing the stored ink jet characteristics;

interpreting the matrix to define a plurality of operating states;

assembling a collection of defined operating states into at least one operating sequence;

comparing ink jet characteristics with the at least one operating sequence for every function of every ink formulation; and applying a conditional test to the a defined operating state.

6. A method for optimizing ink jet printing system operation as claimed in claim 5 wherein the matrices containing stored data are encoded or encrypted to inhibit tampering by printing system operators.

7. A method for optimizing ink jet printing system operation as claimed in claim 5 further comprising the step of changing execution flow based on results of the conditional test.

8. A method for optimizing ink jet printing system operation as claimed in claim 7 further comprising the step of organizing the defined operating states and assembled sequences into an interpretable document.

9. A method for optimizing ink jet printing system operation as claimed in claim 5 wherein the step of storing ink jet characteristics in a computer memory further comprises the step of storing the ink jet characteristics in formatted files.

10. A method for optimizing ink jet printing system operation as claimed in claim 9 wherein the formatted files are accessed by the computer controlling printer operation.

11. A self-configuring ink jet printing structure comprising:

a base program for reading tabulated data and carrying out specified control functions;

means for using the tabulated data and specified control functions to define a plurality of operating states;

at least one operating sequence defined by the plurality of operating states;

at least one table for providing operating parameter data for each operating state in the at least one operating sequence; and means for comparing ink jet characteristics to operating characteristics of the self-configuring ink jet printing structure for every function of every ink formulation.

12. A self-configuring ink jet printing structure as claimed in claim 11 further comprising means for modifying at least one control parameter in the at least one table by values in another table or file.

13. A self-configuring ink jet printing structure as claimed in claim 11 wherein the at least one table contains printhead related parameter data.

14. A self-configuring ink jet printing structure as claimed in claim 11 wherein the at least one table contains ink related parameter data.

15. A self-configuring ink jet printing structure as claimed in claim 11 further comprising means for providing conditional testing.

* * * * *